US007832374B2

(12) United States Patent
Verner et al.

(10) Patent No.: US 7,832,374 B2
(45) Date of Patent: Nov. 16, 2010

(54) FUEL PRESSURE AMPLIFIER

(75) Inventors: Douglas R Verner, Sterling Heights, MI (US); Craig D Marriott, Clawson, MI (US); Kenneth J Buslepp, Brighton, MI (US); Jeff L Swain, Flushing, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/255,275

(22) Filed: Oct. 21, 2008

(65) Prior Publication Data

US 2010/0095935 A1 Apr. 22, 2010

(51) Int. Cl.
*F02M 57/02* (2006.01)

(52) U.S. Cl. ..... 123/446; 123/447; 123/456; 123/511

(58) Field of Classification Search ..... 123/446, 123/447, 456, 495, 509, 510, 511; 239/88
See application file for complete search history.

(56) References Cited

U.S. PATENT DOCUMENTS

| | | | | | |
|---|---|---|---|---|---|
| 4,219,154 | A * | 8/1980 | Luscomb | 239/91 |
| 4,222,358 | A * | 9/1980 | Hofbauer | 123/495 |
| 4,271,807 | A * | 6/1981 | Links et al. | 123/506 |
| 4,437,443 | A * | 3/1984 | Hofbauer | 123/446 |
| 4,449,507 | A * | 5/1984 | Mayer | 123/467 |
| 4,599,861 | A * | 7/1986 | Beaumont | 60/595 |
| 4,838,231 | A * | 6/1989 | Ganser | 123/467 |
| 5,355,856 | A * | 10/1994 | Paul et al. | 123/446 |
| 5,485,957 | A * | 1/1996 | Sturman | 239/88 |
| 5,501,197 | A * | 3/1996 | Smith | 123/509 |
| 5,622,152 | A * | 4/1997 | Ishida | 123/446 |
| 6,113,361 | A * | 9/2000 | Djordjevic | 417/383 |
| 6,499,448 | B2 * | 12/2002 | Yildirim et al. | 123/90.12 |
| 6,637,408 | B2 * | 10/2003 | Djordjevic | 123/456 |
| 6,776,138 | B2 * | 8/2004 | Mahr et al. | 123/446 |
| 6,786,205 | B2 * | 9/2004 | Stuhldreher et al. | 123/495 |
| 6,883,498 | B2 * | 4/2005 | Braun et al. | 123/446 |
| 6,899,088 | B2 * | 5/2005 | Djordjevic | 123/510 |
| 7,278,398 | B2 * | 10/2007 | Magel | 123/446 |
| 7,316,361 | B2 * | 1/2008 | Magel | 239/89 |
| 7,320,311 | B2 * | 1/2008 | Futonagane et al. | 123/446 |
| 7,404,393 | B2 * | 7/2008 | Moore | 123/446 |
| 7,451,742 | B2 * | 11/2008 | Gibson et al. | 123/446 |
| 7,461,795 | B2 * | 12/2008 | Magel | 239/88 |
| 7,578,283 | B1 * | 8/2009 | Bartley | 123/446 |
| 2005/0116058 | A1 * | 6/2005 | Magel | 239/88 |
| 2006/0042565 | A1 * | 3/2006 | Hu | 123/3 |
| 2008/0265054 | A1 * | 10/2008 | Buehler et al. | 239/88 |

* cited by examiner

*Primary Examiner*—Thomas N Moulis
(74) *Attorney, Agent, or Firm*—Cantor Colburn LLP

(57) ABSTRACT

The present invention relates to systems and methods for pressurization of a fuel line of an engine. In one embodiment, a fuel charging system for an engine is provided. The fuel charging system includes a first fuel pump in fluid communication with a fuel tank to generate a first fluid pressure within a first fuel line. The fuel charging system also includes a second fluid pump having a reciprocating piston including a low pressure end and a high pressure end. The low pressure end is in fluid communication with the first fuel pump through the first fuel line and the high pressure end is in fluid communication with an engine fuel rail through a second fuel line. The reciprocating piston is driven by the first fluid pressure to generate a second fluid pressure within the second fuel line, wherein the second fluid pressure is greater than the first fluid pressure.

20 Claims, 4 Drawing Sheets

FUEL PRESSURE AMPLIFIER

FIELD OF THE INVENTION

In accordance with exemplary embodiments, the present invention relates to systems and methods for pressurization of a fuel line of an internal combustion engine, particularly prior to or simultaneously with initial ignition or cranking of the engine.

BACKGROUND

Engines require positive fuel pressure within the fuel line for achieving startup. For certain engines, particularly hybrid engines utilizing ethanol fuel such as E85 Flex Fuel vehicles or otherwise, it is important that sufficient fuel pressure be established relatively quickly; otherwise, the engine may have difficulty starting and/or generate poor exhaust emissions. Also, during cold starts of the engine, or under cold operating conditions, immediate fuel pressure to the engine improves startability of the engine and reduces emissions, such as unburned hydrocarbons. However, to date there have been few designs that provide for rapid pressurization of a fuel line, particularly for ethanol burning engines or for cold starts situations, that are simple in design and relatively cost effective. Accordingly, there exists a need for an improved system and method for providing rapid pressurization of a fuel line of an engine.

SUMMARY OF THE INVENTION

In accordance with exemplary embodiments, the present invention relates to systems and methods for pressurization of a fuel line of an internal combustion engine, particularly prior to or simultaneously with an initial ignition or cranking of the engine. In one particular exemplary embodiment, a fuel charging system for an internal combustion engine is provided. The fuel charging system includes a first fuel pump in fluid communication with a fuel tank. The first fuel pump generates a first fluid pressure within a first fuel line. The fuel charging system also includes a second fluid pump having a reciprocating piston including a low pressure end and a high pressure end. The low pressure end is in fluid communication with the first fuel pump through the first fuel line and the high pressure end is in fluid communication with an engine fuel rail through a second fuel line. The reciprocating piston is driven by the first fluid pressure to generate a second fluid pressure within the second fuel line, wherein the second fluid pressure is greater than the first fluid pressure.

In another particular exemplary embodiment, a method of charging an engine fuel rail of an engine is provided. The method includes: fluidly coupling a first fluid pump to a fuel tank; fluidly coupling a second fluid pump to the first fluid pump and the engine fuel rail, the second fluid pump including a reciprocating piston having a low pressure end and a high pressure end; generating a first fluid pressure with the first fluid pump, the first fluid pressure acting on the low pressure end of the second fluid pump; and generating a second fluid pressure with the high pressure end of the second fluid pump proportional to the first fluid pressure, the second fluid pressure being greater than the first fluid pressure.

The above-described and other features and advantages of the exemplary embodiments of the present invention will be appreciated and understood by those skilled in the art from the following detailed description, drawings, and appended claims.

BRIEF DESCRIPTION OF THE DRAWINGS

Other objects, features, advantages and details of the exemplary embodiments appear, by way of example only, in the following detailed description of the exemplary embodiments, the detailed description referring to the drawings in which.

DESCRIPTION OF THE EXEMPLARY EMBODIMENTS

Exemplary embodiments of the present invention provide for distribution of fuel to a fuel system of an engine. More so, exemplary embodiments provide for rapid pressurization of fuel lines used to supply components of the engine, such as fuel rails or otherwise, through the use of a hydraulic multiplier used to passively prime the fuel rail. This is particularly advantageous for engines requiring rapid fuel pressurization or fuel pressurization prior to starting or cranking of the engine, such as engines using ethanol or other less volatile burning agents, or engines operating in cold climates. This also provides for reduced emissions during start-up of the engine, such as reduced hydrocarbons or otherwise. In one configuration, the fuel charging system includes a pump configured to cause pressurization of a fuel rail prior to or simultaneously with initial rotation of the engine, such as is typically done by an engine starter. Advantageously, this fuel pressurization reduces or eliminates fuel vapors and collapses air within the fuel system into the fuel solution to create a single mixture. Such pressurization may be initiated by a user through a remote device, such as a radio frequency identification device (RFID), remote unlocking device, or otherwise. Such pressurization may also be initiated by a user proximate to the vehicle, such as during unlocking or opening of a vehicle door, placement or rotation of a key in an ignition or otherwise. Accordingly, no longer is the fuel system dependent upon mechanical rotation of a fuel pump for causing pressurization of a fuel line during the initial start of the engine.

In one configuration, the fuel charging system includes an amplification pump configured to amplify fuel pressure for a fuel rail of an engine. The amplification pump is powered by fluid pressure formed by a low pressure pump associated with a fuel tank. The low pressure pump also provides a source of fuel for the amplification pump. In one particular configuration, the amplification pump includes a moveable member, such as a piston, having a first surface area in fluid communication with the low pressure pump and a second surface area in fluid communication with the fuel rail, wherein the first area is greater than the second surface area. This surface area ratio provides the ability to concentrate the force generated by the low pressure pump to a smaller surface area thus increasing the fluid pressure to the fuel rail, e.g., pounds per square inch (PSI) or Pascals. Once the engine begins operation, a mechanically driven pump continues to provide suitable fuel pressurization for the fuel rail.

Figure 1:
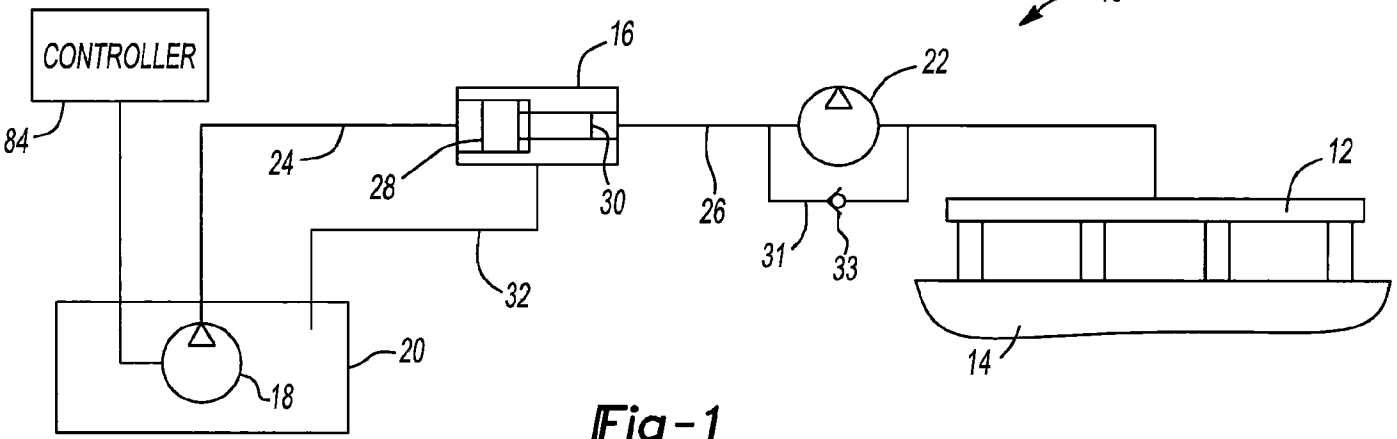
FIG. 1 illustrates a schematic view of an exemplary embodiment of a fuel charging system of the present invention.
Figure 2:
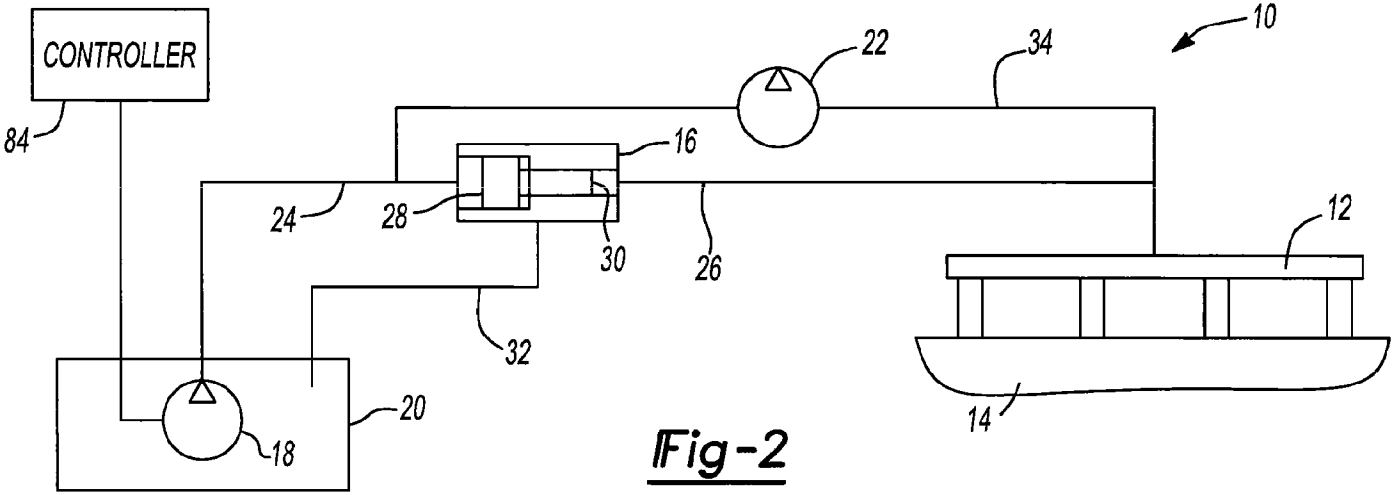
FIG. 2 illustrates a schematic view of another exemplary embodiment of a fuel charging system of the present invention.

For example, referring to the exemplary embodiments shown in FIGS. 1 and 2, a fuel charging system 10 for a fuel rail 12 of an engine 14 is provided. The fuel charging system includes an amplification pump 16 that is in fluid communication with a low pressure pump 18, which is in further fluid communication with a fuel tank 20. The amplification pump 16 is also in fluid communication with the fuel rail 12. In operation, the low pressure pump 18 provides fuel to amplification pump 16. The low pressure pump 18 also provides a first fluid pressure suitable for driving amplification pump 16. As a result of the first fluid pressure and fuel supply, the amplification pump generates a second fluid pressure to the fuel rail 12 suitable for providing the engine 14 with suitable fuel pressure and supply prior to or simultaneous with starting of the engine. Once cranking of the engine 12 has begun, a high pressure fuel pump 22, which may be mechanically driven through the engine, provides suitable fuel pressure to the fuel rail 12 for maintaining operation of the engine.

More particularly, in the exemplary embodiment shown in FIG. 1, the amplification pump 16 of the fuel charging system 10 is in fluid communication with low pressure pump 18 through supply line 24. The low pressure pump 18 provides suitable fuel supply and first fluid pressure through line 24, for driving the amplification pump 16. The amplification pump 16 is also in fluid communication with fuel rail 12 through pressure line 26. In the embodiment shown, the amplification pump 16 comprises a piston pump having a first surface area 28 in driving communication with the low pressure pump 18 and a second surface area 30 in driving communication with the fuel rail 12. With the first surface area 28 being greater than the second surface area 30 an increased fluid pressure, as compared to the first fluid pressure, is generated for the fuel rail 12, without the necessary use of high pressure fuel pump 22. However, once the engine 14 has been started, the high pressure fuel pump 22 generates additional fluid pressure for supplying the fuel rail 12 with fuel. In this configuration, the high pressure fuel pump 22 is located in series with the amplifier pump 16. The fuel charging system 10 is configured to allow fuel to bypass the high pressure fuel pump 22, through bypass line 31 and valve 33 (such as a passive check valve), for fluid flow between the amplification pump 16 and fuel rail 12. Also, a return line 32 is provided to return unused or excess air or fuel to the fuel tank 20. Such return line 32 may be particularly advantageous for preventing binding or fluid locking of the pump during operation.

In the exemplary embodiment shown in FIG. 2, the fuel charging system 10 is generally the same with the exception of the relationship of the high pressure fuel pump 22 to the amplification pump 16. In this configuration, the high pressure fuel pump 22 is located in parallel with the amplifier pump 16. As such, the fuel pressure generated by the amplifier pump 16 goes directly to the fuel rail 12 as opposed to going through the high pressure fuel pump 22 and fuel pressure generated by the high pressure fuel pump also goes directly to the fuel rail 12, via high pressure line 34. Further, high pressure fuel pump 22 does not receive fuel through the amplifier pump 16, but instead, directly from the low pressure pump 18.

Figure 3:
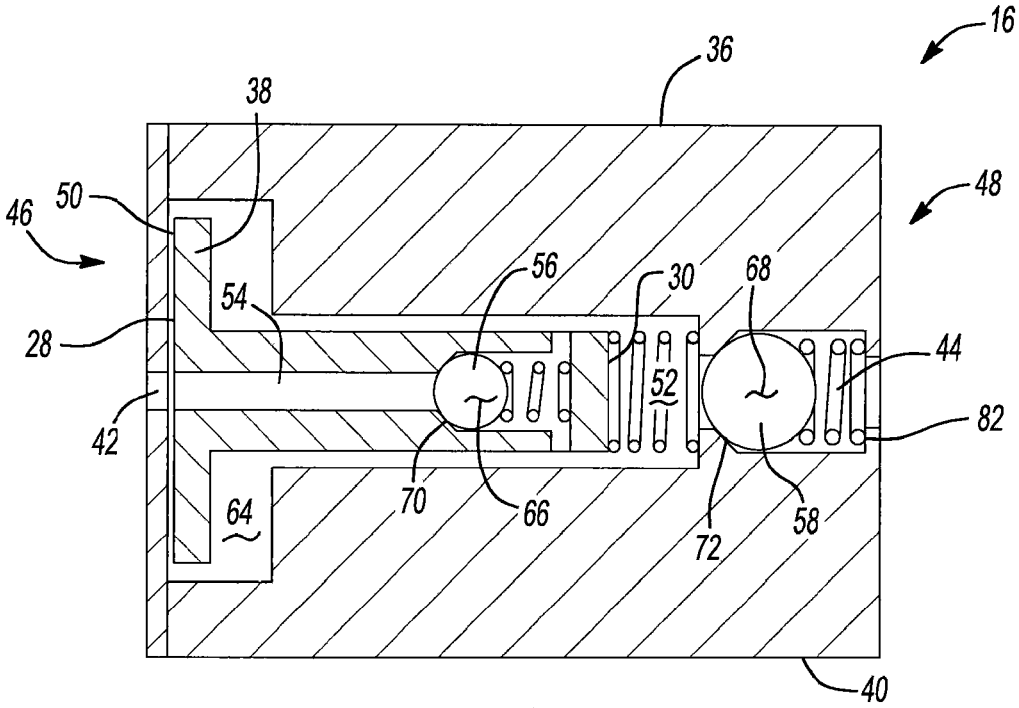
FIG. 3 illustrates a cross-section view of an exemplary embodiment of a charger assembly of the present invention in a first position.
Figure 4:
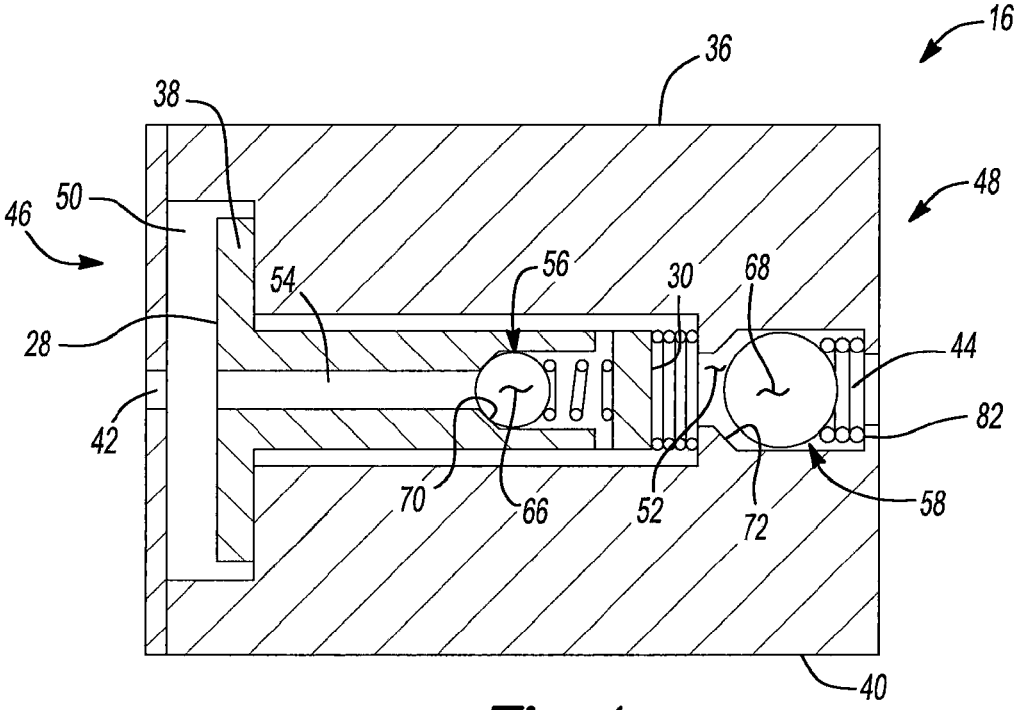
FIG. 4 illustrates a cross-section view of an exemplary embodiment of a charger assembly of the present invention in a second position.
Figure 5:
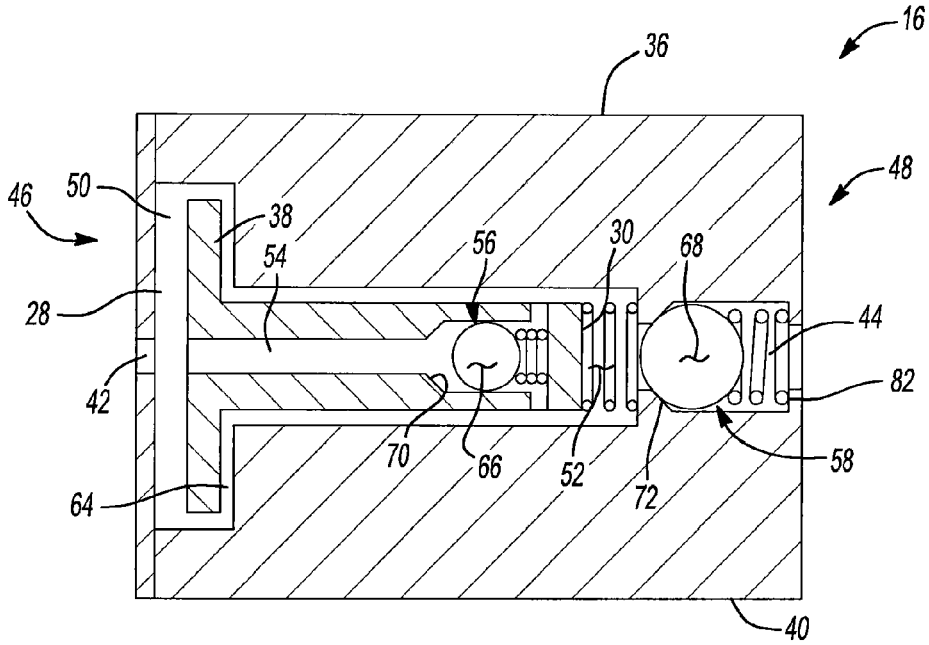
FIG. 5 illustrates a cross-section view of an exemplary embodiment of a charger assembly of the present invention in a third position.

In greater detail, the amplifier pump 16 may comprise any suitable passive pump for providing a supply of high pressure fuel as a result of fluid pressure generated by the low pressure pump 18. With reference to the exemplary embodiments shown in FIGS. 3-5, in one configuration the amplifier pump 16 comprises a piston pump 36. The piston pump 36 includes a piston 38 that is moveably disposed within a piston housing 40. The piston housing 40 defines a fluid inlet port 42 fluidly coupled to low pressure pump 18 and fluid outlet port 44 fluidly coupled to the fuel rail 12; the fluid inlet port being located at a first end 46 of the piston housing and the fluid outlet port being located at a second end 48 of the piston housing. The piston 38 includes first surface area 28, located in a low pressure cavity 50 of the piston housing 40, which is in fluid communication with low pressure pump 18, via fluid inlet port 42. The piston 38 also includes second surface area 30, located in a high pressure cavity 52 of the piston housing 40, which is in fluid communication with the fuel rail 12, via fluid outlet port 44. It should be appreciated that piston 38 includes sealing features or is otherwise sized to limit fluid flow between the piston 38 and piston housing 40 during movement of the piston. Accordingly, during application of the first fluid pressure against the first surface area 28 of the piston 38, e.g., fluid entering the low pressure cavity 50, the piston moves thereby causing fluid to be displaced from the high pressure cavity 52 to generate the second fluid pressure.

In one exemplary embodiment, with respect to the piston pump 36, the first surface area 28 and second surface area 30 may vary depending on the desired output pressure, e.g., second fluid pressure or otherwise. It is contemplated that a surface area ratio is formed between the first surface area 28 and the second surface area 30. This surface area is directly correlated to a pressure ratio between the first pressure and the second pressure. In one configuration, the area ratio is between about 2:1 to about 10:1 with respect to the first and second surface area. In another configuration the second surface area is at least about twice as large as the first surface area. In one particular configuration, the area ratio is about 7:1.

With respect to first and second surface area ratios, certain pressures can be expected, for the high pressure, through the cyclical action of the pump. Such cyclical action will continue until pressure equalization is achieved, e.g., the pressure generated by the piston pump 36 is equal to the pressure within the fuel rail 12. For example, in one configuration, upon cyclical action of the pump, the maximum pressure generated within the pump may be as much as about 2 MPa. However, other pressures are contemplated which may be based upon the desired rate for pressurizing of the fluid rail 12.

Piston 38 includes fluid passage 54 for providing fluid communication between the high pressure cavity 52 and low pressure pump 18. The piston 38 further includes a first check valve 56 for preventing fluid flow through the fluid passage during generation of the second fluid pressure. This configuration provides fluid flow through fluid passage 54 during movement of the piston 38 towards the first side 46 of the piston housing 40 but prevents fluid flow through the fluid passage during movement of the piston towards the second side 48 of the piston housing. The prevention of fluid flow through the fluid passage 54 during movement of the piston towards the second end of the piston housing provides for incremental pressure build up of the second fluid pressure within the fuel rail 12. Accordingly, repetitious movement of the piston 38 between the first and second end 46, 48 of the piston housing 40 progressively increases the second fluid pressure within the fuel rail through incremental pressure buildup. The build up of pressure is further achieved through a second check valve 58 configured for maintaining the incremental pressure build up within the fuel rail 12. This movement is continuous until the incremental pressure generated by piston 38 is equal to that of the second fluid pressure, e.g., pressure built up within the fuel rail 12.

Figure 6:
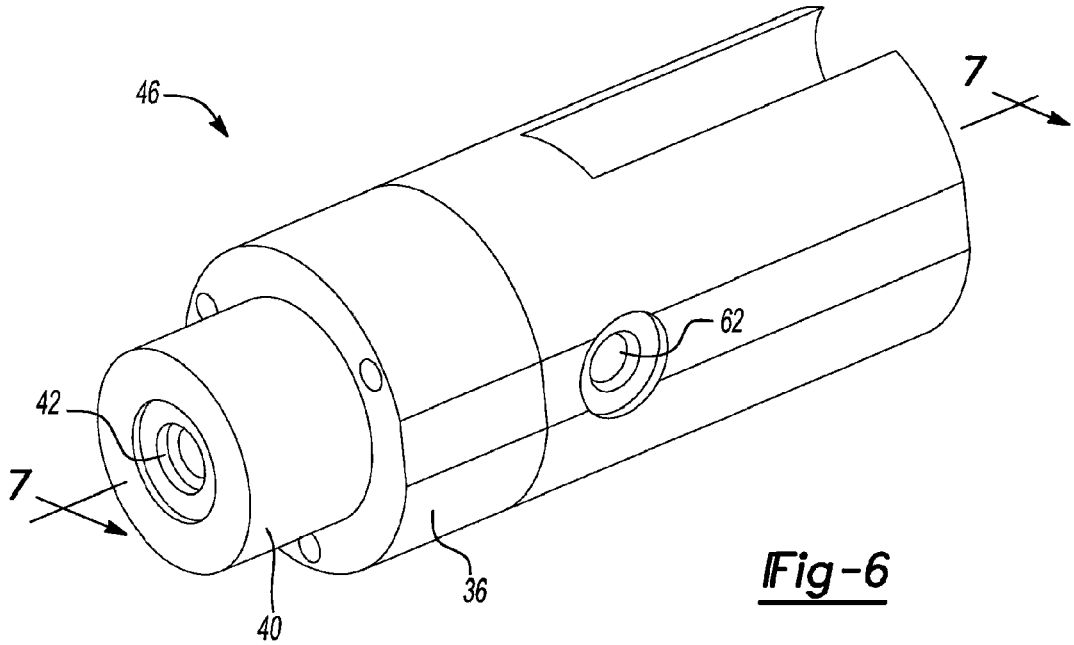
FIG. 6 illustrates a perspective view of another exemplary embodiment of a charger assembly of the present invention.
Figure 7:
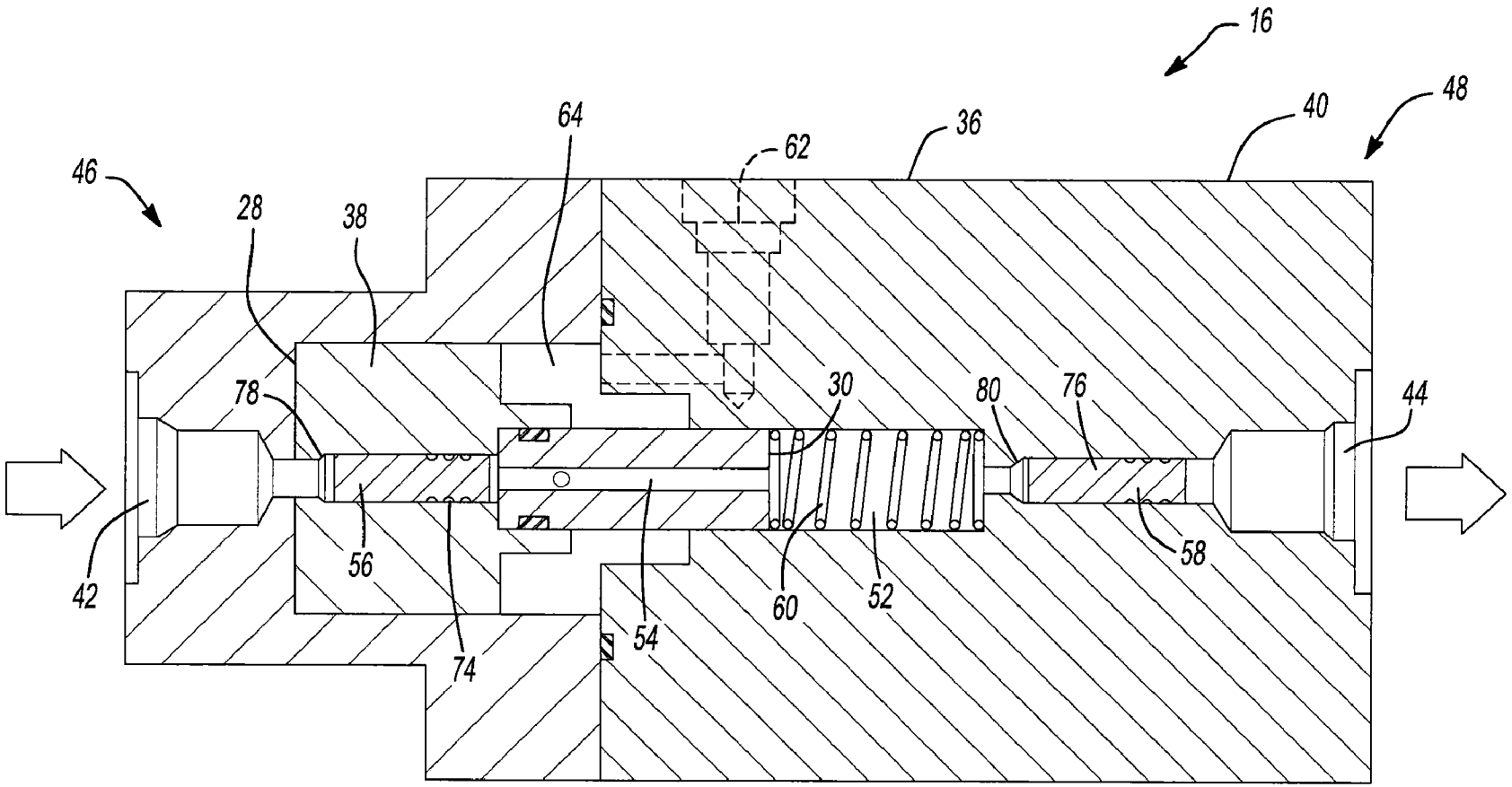
FIG. 7 illustrates a cross-section view taken along 7-7 of the charger assembly shown in FIG. 6.

Piston pump 36 is further configured for movement of the piston 38 during a non-compressive stroke, e.g., movement of the piston from the second end 48 of the piston housing 40 towards a first end 46 of the piston housing. In one exemplary embodiment, referring to FIGS. 6-8, the piston pump 36 includes a return spring 60 disposed between the piston housing 40 and the piston 38 for returning piston 38 to an original position upon incremental pumping of piston 38. Movement of the piston, e.g., movement towards the second end 48 of the piston housing 40 is further improved upon through a vent opening 62 formed by piston housing 40, which is in fluid communication with return line 32. As such, during movement of the piston towards the second end 48 of the piston housing 40, fluid or air located within intermediate cavity 64 travels back to fuel tank 20. This fluid is replaced by fluid from the fuel tank 20 during movement of the piston back towards the first end 46 of the piston housing 40. Other vent opening configurations are possible.

Referring again to the first and second check valves 56, 58, the establishment and prevention of fluid flow into and out of the high pressure cavity 52 may be established in a number of different ways. For example, with reference to FIGS. 3-5, the first and second check valves comprise first ball 66 and second ball 68, respectively. In this configuration, piston 38 includes first seat 70 configured to receive first ball 66 and prevent fluid flow therethrough. When the first ball 66 becomes unseated from the first seat, fluid is allowed to flow past the first ball, which may be facilitated through one or more fluid paths (not shown) formed by piston 38. Similarly, piston housing 40 includes second seat 72 configured to received second ball 68 and prevent fluid flow therethough. As with the first seat, when the second ball 68 becomes unseated from the second seat 72, fluid is allowed to flow past the second ball. With reference to the exemplary embodiment shown in FIGS. 6-8, the first and second check valves comprise first cylindrical valve member 74 and second cylindrical valve member 76. In this configuration, piston 38 includes first seat 78 for receiving first cylindrical valve member 74 and the piston housing 40 includes a second seat 80 for receiving second valve member 76. Piston 38, piston housing 40 and/or first and second cylindrical valve members 74, 76 include one or more fluid paths for allowing fluid to past thereby upon unseating or movement of the first and second cylindrical valve members away from first and second seat 78, 80. It should be appreciated that other configurations are available.

With respect to an operational sequence of the amplification pump shown in FIGS. 3-5 and FIGS. 6-8, upon generation of a first fluid pressure through low pressure pump 18, fuel enters first inlet port 42 and fills first low pressure cavity 50 to apply a first pressure against first surface area 28 of piston 38. This first pressure causes movement of piston 38 from the first end 46 of piston housing 40 towards the second end 48 of piston housing, wherein fluid or air within intermediate cavity is vented through vent opening 62 and to fuel tank 20, via return line 32. During this movement, first ball 66 (or first cylinder valve member 74) is pressed against first seat 70 (or first seat 78) preventing movement of fuel through fluid passage 54. Accordingly, during movement of the piston towards the second end 48 a second fluid pressure is generated, through second surface area 30, which exits via second check valve 58. As should be appreciated, due to the smaller surface area of the second surface area 30, as compared to the first surface area 28, the second fluid pressure is greater than the first fluid pressure and proportional to the ratio of the first and second surface areas 28, 30. The generated second fluid pressure unseats second ball 68 (or second cylindrical valve member 76) from seat 72 (or second seat 80) to allow fuel flow through outlet port 44 and provide compressed fuel for the fuel rail. The second ball 68 is returned to its original position through return spring 82.

Once the piston 38 has been fully deployed towards the second end of the piston housing and pressure from the low pressure pump is actively removed or depleted, a spring force (e.g., return spring 60) returns the piston to its original position towards the first end 46 of the piston housing 40. During this return motion, first ball 66 (or first cylindrical valve member 74) unseats allowing fluid to flow through fluid passage 54 to fill high pressure cavity 52, at the low pressure rate. Also, the fuel pressure built up within the fuel rail 12, or connection thereto, i.e., pressure line 26, causes second ball 68 (or second cylindrical valve member 76) to be seated against second seat 72 (or second seat 80) thereby preventing fluid flow back into high pressure cavity 52. Once the piston has returned to an original position, then the low pressure pump 18 is used to actively generate fluid pressure thereby repeating the process until the second fuel pressure within the fuel rail, or fluid connector thereto, i.e., pressure line 26, is equal to the pressure generated by the second surface area 30. Accordingly, the amplification pump 16 becomes a reciprocating pump powered by intermittent activation of the low pressure pump.

It should be appreciated that other amplification pumps 16 are available which provide increased fluid pressure based upon a lower fluid pressure. It is further contemplated that the amplification pump may comprise any means of converting mechanical force to hydraulic pressure including vanes, gears, pistons or otherwise. Still further, a hydraulic motor may be used to drive a smaller pump. Other configurations are contemplated.

In one exemplary embodiment, one or more components of the fuel charging system 10, are controlled through a controller 84. The controller may be in power communication, signal communication, or both, to one or more components through an electrical conduit, such as a wire 86. For example, the controller 84 may be configured for providing power and/or controlling operation (e.g., speed or otherwise) of the low pressure pump and thus the amplification pump 16. The controller 84 may also be configured for synchronizing operation of the low pressure pump 18 and amplification pump 16. Thus, the controller may include instructions and/or algorithm for activating (intermittent or otherwise) the low pressure pump and the thus the passive amplification pump. These instructions may be configured to generate a specific pressure within the fuel rail through a pre-set number of cyclical movements of the piston 38 of the piston pump 36. The controller 84 may comprise a stand alone component or may comprise a portion of a more encompassing controller, such as an engine control unit of a vehicle.

Referring again to the fuel charging system shown in FIGS. 1 and 2, the system includes low pressure pump 18 and high pressure fuel pump 22. The low pressure pump 18 may comprise any suitable pump used for movement of fluid from a fuel tank towards an engine. In one configuration, the low pressure pump comprises an electrically driven pump located within the fuel tank. The electrically driven pump creates positive pressure in the supply line 24, thereby pushing fuel towards the engine, or as in the present case towards the amplification pump 16 and high pressure fuel pump 22. Such a pump may be driven through the electric system of the engine or vehicle. In one exemplary operation, the low pressure pump begins pumping of fuel to the passive amplification pump 18 thereby causing activation of the amplification pump 18. Accordingly, the electrically driven pump must begin operation during one of the operational times of the amplification pump, e.g., prior to entering a vehicle of an engine, during unlocking or opening of a vehicle door of the engine, during placement of a key in an ignition system of the engine, during rotation of the key of the ignition system or otherwise. With respect to the high pressure fuel pump 22, the high pressure fuel pump may also include any suitable pump for pressurization of fuel rail 12. In one configuration, the high pressure fuel pump 22 is mechanically driven by the engine 14, such as through drive belt, camshaft or otherwise. Accordingly, in one configuration the high pressure fuel pump 22 begins pumping fuel, or pressurizing the fuel rail, after initiation of starting the engine begins. This lends itself to the desirable use of the amplification pump 18 of the present invention as fuel is pressurized prior to or simultaneous with the starting of the engine.

It should be appreciated that the fuel charging system may be used with different types of engines and in different engine applications. For example, the fuel charging system 10 may be used in gasoline engines, diesel engines, hybrid engines such as ethanol or alcohol burning engines or otherwise. Also, the fuel charging system 10 may be used in stationary engines, such as power generators, pumps or otherwise. The fuel charging system 10 may be used in non-stationary engines such as vehicle engines. Other applications are possible.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A fuel charging system for an internal combustion engine, comprising:

a first fuel pump in fluid communication with a fuel tank, the first fuel pump generating a first fluid pressure of a fuel within a first fuel line; and a second fluid pump having a reciprocating piston that communicates the fuel from a low pressure end through the second fluid pump to a high pressure end, the low pressure end being in fluid communication with the first fuel pump through the fuel in the first fuel line and the high pressure end being in fluid communication with an engine fuel rail through the fuel in a second fuel line, the reciprocating piston being driven by the first fluid pressure to generate a second fluid pressure of the fuel within the second fuel line, the second fluid pressure being greater than the first fluid pressure.

2. The fuel charging system of claim 1, wherein the low pressure end of the reciprocating piston has a first cross sectional surface area in fluid communication with the first fuel pump and the high pressure end of the reciprocating piston has a second cross sectional surface area in fluid communication with the fuel rail, the first cross sectional surface area being greater than the second cross sectional surface area.

3. The fuel charging system of claim 2, wherein the first cross sectional surface area is at least twice as large as the second cross sectional surface area.

4. The fuel charging system of claim 3, wherein the second fluid pressure is at least about 2 MPa.

5. The fuel charging system of claim 1, further comprising a third fuel line fluidly connecting the second fuel pump to the fuel tank, the third fuel line comprising a return line for allowing fuel to travel from the second fuel pump to the fuel tank.

6. The fuel charging system of claim 1, wherein the first fuel pump comprises an electric pump located within the fuel tank.

7. The fuel charging system of claim 1, further comprising a third fuel pump in fluid communication with the first fuel pump and the fuel rail.

8. The fuel charging system of claim 7, wherein the third fuel pump is in further fluid communication with the second fuel pump and operates in series with the second fuel pump.

9. The fuel charging system of claim 7, wherein the third fuel pump operates in parallel with the second fuel pump.

10. The fuel charging system of claim 7, wherein the third fuel pump is mechanically driven by the internal combustion engine.

11. A method of charging an engine fuel rail of an engine, comprising:

fluidly coupling a first fluid pump to a fuel in a fuel tank;

fluidly coupling a second fluid pump to the first fluid pump and the engine fuel rail using the fuel, the second fluid pump including a reciprocating piston that communicates the fuel from a low pressure end through the second fluid pump to a high pressure end;

generating a first fluid pressure of the fuel with the first fluid pump, the first fluid pressure acting on the low pressure end of the second fluid pump; and generating a second fluid pressure of the fuel with the high pressure end of the second fluid pump proportional to the first fluid pressure, the second fluid pressure of the fuel being greater than the first fluid pressure.

12. The method of claim 11, wherein the low pressure end of the reciprocating piston includes a cross sectional surface area that is at least twice as large as a cross sectional surface area of the high pressure end of the reciprocating piston.

13. The method of claim 11, wherein the first fluid pump comprises an electric pump.

14. The method of claim 13, wherein the electric pump generates the first fluid pressure based upon an electrical signal generated by a user of the engine.

15. The method of 14, wherein the signal is generated by a remote entry device for a vehicle of the engine.

16. The method of 14, wherein the signal is generated upon insertion of a key into an ignition system of a vehicle, upon rotation of a key within an ignition system of a vehicle or both.

17. The method of claim 11, further comprising the step of fluidly coupling a third fluid pump to the first fluid pump and the fuel rail, the third fluid pump generating a third fluid pressure.

18. The method of claim 17, wherein the second fluid pump and the third fluid pump are fluidly coupled in series, the third fluid pump providing fuel to the engine fuel rail at the third fluid pressure.

19. The method of claim 17, wherein the second fluid pump and the third fluid pump are fluidly coupled in parallel, the third fluid pump providing fuel to the engine fuel rail at the third fluid pressure.

20. The method of claim 17, wherein the third fluid pump comprises a mechanical pump driven by an engine.

* * * * *